United States Patent [19]

Gazzoni

[11] 4,200,991

[45] May 6, 1980

[54] DRIER FOR SMALL SIZED MATERIALS

[75] Inventor: Domenico Gazzoni, Como, Italy

[73] Assignee: Sorema, Srl, Erba, Italy

[21] Appl. No.: 916,862

[22] Filed: Jun. 19, 1978

[51] Int. Cl.[2] ..... F26B 17/00

[52] U.S. Cl. ..... 34/57 R

[58] Field of Search ..... 34/10, 17, 57 B, 57 C, 34/57 R; 432/14

[56] References Cited

U.S. PATENT DOCUMENTS

| | | | |
|---|---|---|---|
| 2,235,748 | 3/1941 | Hukill | 34/10 |
| 3,394,463 | 7/1968 | Futer | 34/10 |
| 3,805,401 | 4/1974 | Fontein | 34/10 |

*Primary Examiner*—John J. Camby

*Attorney, Agent, or Firm*—Stevens, Davis, Miller & Mosher

[57] ABSTRACT

This invention relates to a drier for small sized material, of the kind in which the wet material is conveyed through the drier by an air flow and is stripped of its moisture contents by slamming against a gridlike wall which is inclined with respect to the direction of flow. According to the invention a secondary air flow is introduced into the material conveying duct as forming an acute angle with said gridlike wall.

5 Claims, 4 Drawing Figures

DRIER FOR SMALL SIZED MATERIALS

This invention relates to a drier for a small sized material, of the kind in which the wet material is conveyed through the drier by a searching air stream and is stripped of its moisture contents by slamming it against an appropriate gridlike wall which is more or less inclined relative to the direction of flow.

In the conventional driers of the type referred to above, to the above indicated air stream of conveyance is often superposed a transversal air stream which, perpendicular to the former, and which pushes the wet material with an additional force against the gridlike wall, thus improving the removal of moisture.

Such perpendicular air stream, which is generally produced by a centrifugal blower, has, however, the defect of causing a crushing of the material against the gridlike wall, the result being that the material itself loses its advance motion and by sticking to the gridlike wall virtually waterproofs the latter. This obviously reduces the drying capacity of the drier considerably.

In view of these facts, the object of the present invention is essentially that of providing an airflow drier of the kind referred to above which is exempt from the defect indicated hereinabove.

The general object of the present invention is then to provide an airflow drier which is extremely simple, which requires a minimum upkeep and has an outstanding capacity of driving off the moisture with a minimum consumption of power.

The objects of the invention are achieved by means of a drier comprising an inlet duct for a main stream of the conveying air, an area for introducing the material placed at the outlet of said inlet duct and a duct for conveying the material by means of such air stream, forming an acute angle with the inlet duct and equipped with a gridlike wall for retaining and deflecting the material in the direction of conveyance, characterized in that it comprises at least a duct for introducing a secondary air stream communicating with said conveyance duct through bores formed through a wall of the latter opposite to the gridlike wall, said bores being so formed that the secondary stream enters the conveyance duct by forming an acute angle with said gridlike wall.

According to the invention, the secondary or transversal air stream is thus no longer perpendicular to the main air stream or conveying stream, but it forms, with the same, or better to speak with the gridlike wall which directs it along the material-conveying duct, an acute angle (preferably 45 degrees or a bit less) which permits that the demoisturizing capacity of the drier may be improved without thereby causing undesirable phenomena of crushing of the material and waterproofing of the gridlike wall. In addition, the clogging of the bores of the gridlike wall by dirt is prevented.

Such an appreciable increase of the demoisturizing ability takes place, above all by virtue of the suppression of centrifugal blowers or other like means as conventionally used heretofore, so that it is possible concurrently to obtain a greater simplicity of construction, a lesser demand for upkeep and a reduce power demand.

The foregoing and other features of the present invention will better be understood by the scrutiny of the ensuing detailed description of a possible practical embodiment thereof shown by way of example in the accompanying drawings.

Figure 1:
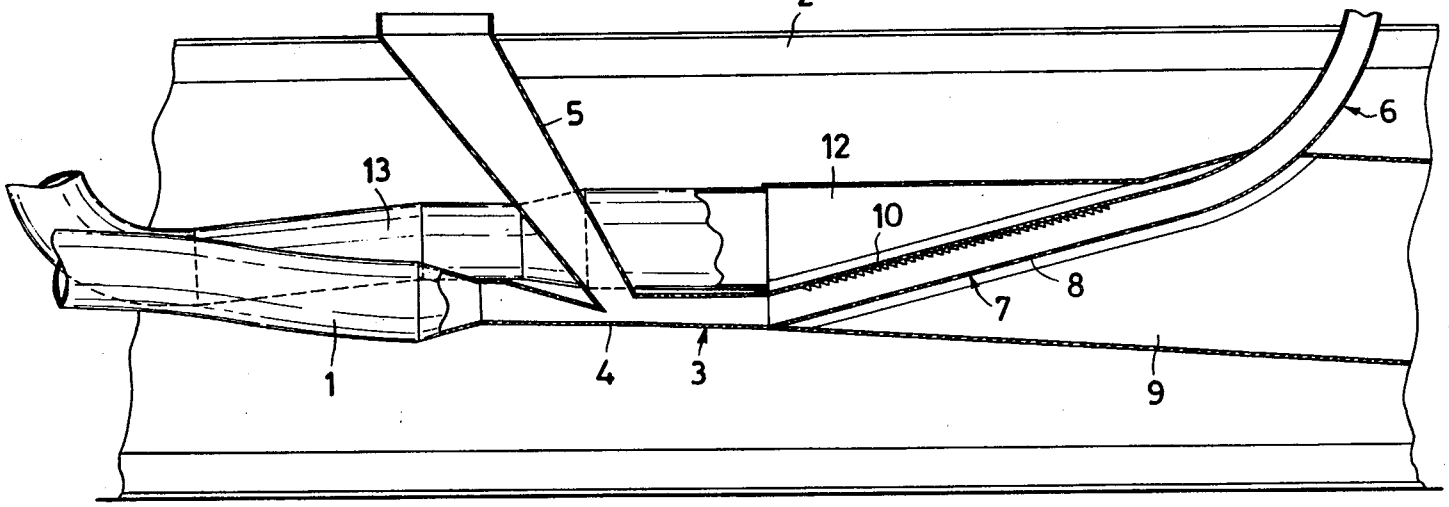
FIG. 1 shows a drier according to the invention in longitudinal cross-sectional view along the line I—I of FIG. 2.

The drier shown in the drawings comprises in the first place a duct 1 for introducing a main air stream for conveyance as fed by a source of compressed air (not shown in the drawings) through appropriate pressure-adjusting means (also not shown in the drawings).

At the outlet of the intake duct 1, in the interior of a box 2, there is an area 3 of introduction of the wet material into the main air stream as fed by the duct 1. Said introduction area comprises a flattened Venturi 4, into which opens a hopper 5 (FIG. 1) for feeding the wet material to be dried.

At the outlet of the introduction area 3 there is placed, in its turn a duct 6 for conveying the wet material by means of said main air stream. The duct 6 has an initial rectilinear portion 7 having a rectangular (or square) cross-sectional outline and forms an acute angle (about 15 degrees) with the outlet of the introduction area 3. Said rectilinear portion comprises a gridlike wall 8, against which the wet material conveyed by the main air stream is intended to be hurled for the subsequent demoisturizing step. Beneath the gridlike wall 8, a channel 9 is provided for collecting and discharging the liquid which has oozed through the bores of the gridlike wall.

Figure 3:
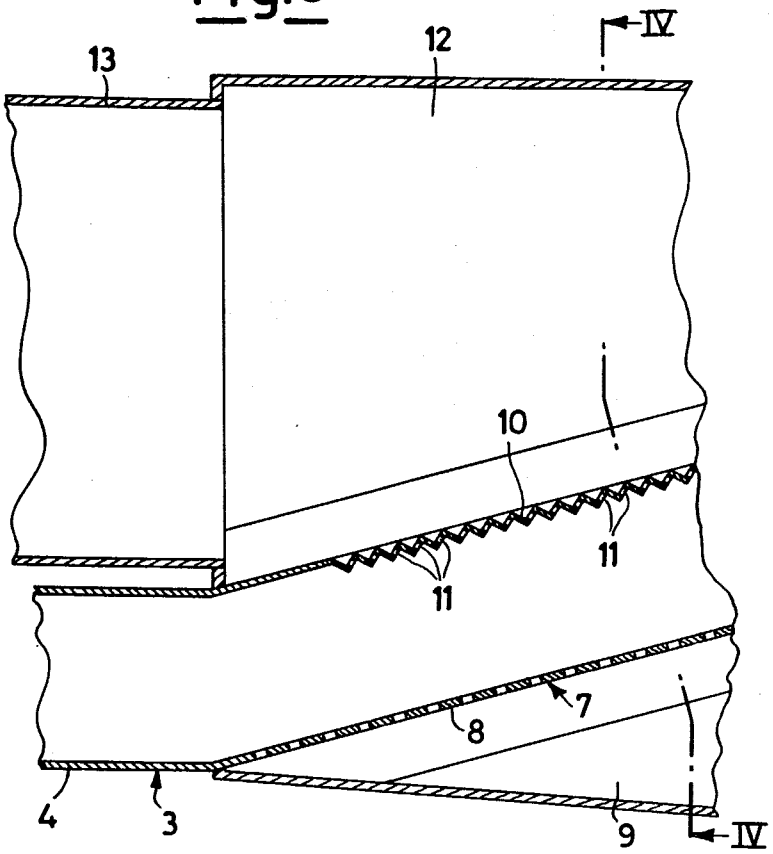
FIG. 3 shows a portion of the drier in lengthwise cross-sectional view taken along the same line as in FIG. 1.

A wall 10 of the conveyance duct 6, which is opposite to the gridlike wall 8, has a number of perforations 11 (FIG. 3) which are so formed and directed as to define a direction of flow forming an acute angle (preferably 45 degrees or a bit less) with the axis of the rectilinear portion 7 of the duct 6.

Figure 2:
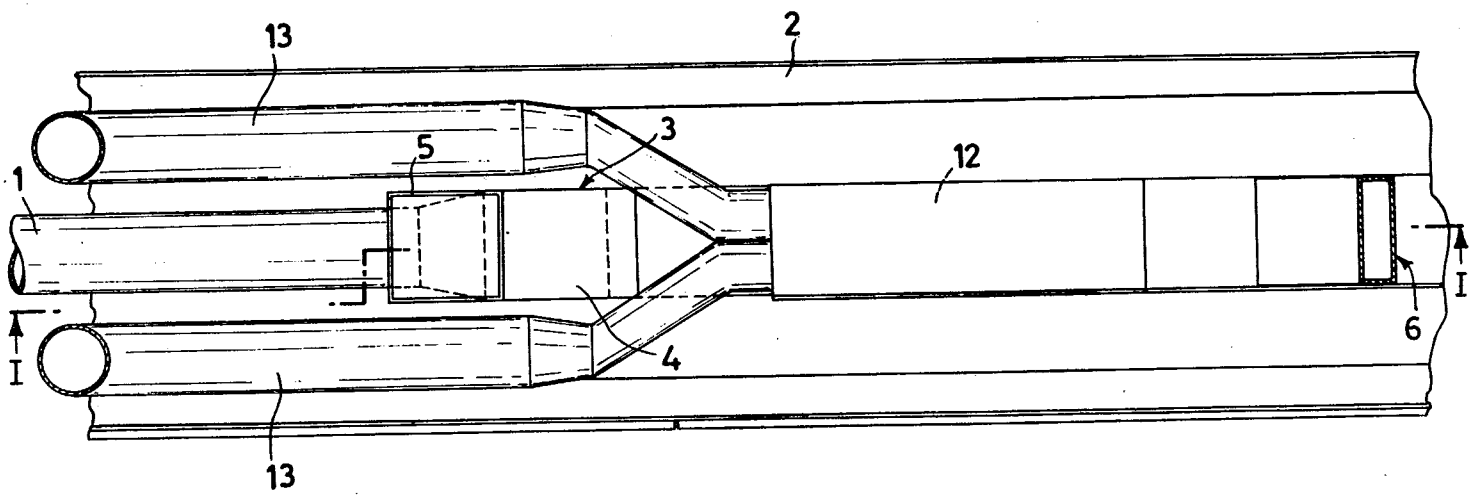
FIG. 2 shows the same drier in top plan view.
Figure 4:
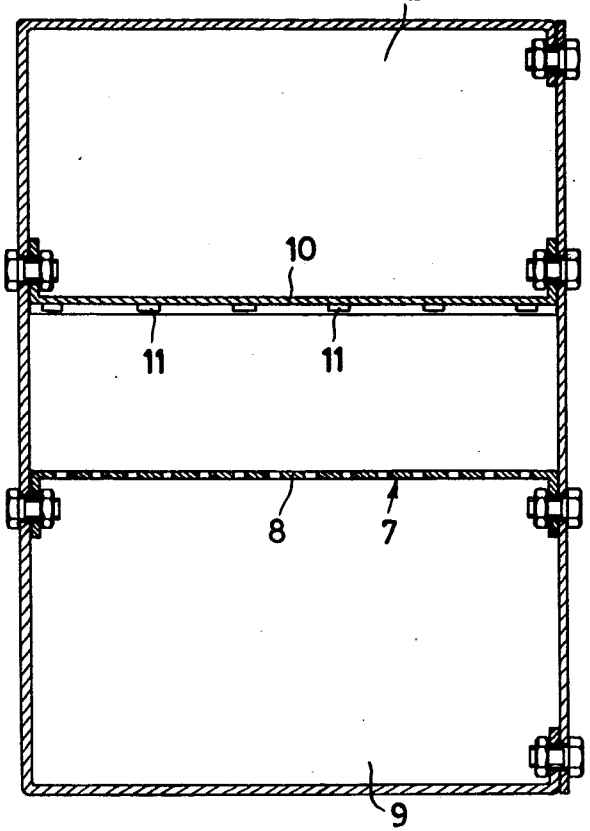
FIG. 4 shows said portion of the drier in transversal cross-sectional view taken along the line IV—IV of FIG. 3.

The duct 6 communicates through the bores 11 with a chamber 12 (FIGS. 1, 3 and 4) into which open two ducts 13 of introduction of the respective secondary air streams (FIG. 2). These streams are preferably fed by the same source of air which feeds the main duct 1, independent means being however preferably provided for adjusting the pressure.

In operation, the main air stream fed through the introduction duct 1 under a properly adjusted pressure consistently with the nature of the material to be dried is expanded laterally into the flattened Venturi 4 and here it takes wet material from the hopper 5.

By being subsequently introduced into the rectilinear section 7 of the conveyance duct 6, the main air stream and the material entrained thereby encounter the gridlike wall 8, the slope of which causes the material to be slammed against the same wall. Such a slamming is encouraged, but not to such an extent as to induce crushing, by the secondary transversal flow entering with the desired inclination through the bores 11 of the wall 10.

As a result, the wet material loses the liquid which imbibes it and the latter seeps through the perforations of the gridlike wall 8 and is then dumped through the channel 9. The bores are kept clean by the transversal air flow coming from the chamber 12. Under the thrust of main air stream and without any hindrance by the transversal stream, the thusly demoisturized material continues meanwhile its run until reaching the outlet of the drier.

I claim:

1. A drier for lightweight material of small particle size comprising a main air stream duct for introducing a main air stream for conveyance, a plenum communicating with said main air stream duct, a hopper communicating with said plenum for introducing material, said hopper being placed at the outlet of said main air stream duct, a duct communicating with said plenum for conveyance of the material by means of said air stream from said plenum, said conveyance duct forming an acute angle with said main air stream duct and having a gridlike wall for retaining the material and deflecting it in the direction of conveyance, and at least one secondary airflow duct communicating with said conveyance duct through bores formed through a wall thereof opposite to the gridlike wall aforesaid for introducing a secondary airflow, said bores being so formed that said secondary stream enters the conveyance duct by forming an acute angle with said gridlike wall and flows in a direction concordant with that of the main air stream.

2. The drier according to claim 1, wherein said acute angle formed by said secondary stream and said gridlike wall is equal to 45 degrees or less.

3. The drier according to claim 1, wherein said acute angle formed by said conveyance duct and said main air stream duct is approximately equal to 15 degrees.

4. The drier according to claim 1, wherein said plenum comprises a flattened Venturi.

5. The drier according to claim 1, wherein said conveyance duct has a rectangular or a square cross-sectional outline.

* * * * *